US009816313B2

(12) United States Patent
Nelson

(10) Patent No.: US 9,816,313 B2
(45) Date of Patent: Nov. 14, 2017

(54) HIGH PERFORMANCE ACOUSTICAL WOOD DOOR

(71) Applicant: AADG, Inc., Mason City, IA (US)

(72) Inventor: Andrew N. Nelson, Mason City, IA (US)

(73) Assignee: AADG, Inc., Mason City, IA (US)

( * ) Notice: Subject to any disclaimer, the term of this patent is extended or adjusted under 35 U.S.C. 154(b) by 0 days.

(21) Appl. No.: 15/216,229

(22) Filed: Jul. 21, 2016

(65) Prior Publication Data

US 2017/0030140 A1 Feb. 2, 2017

Related U.S. Application Data

(60) Provisional application No. 62/198,939, filed on Jul. 30, 2015.

(51) Int. Cl.

| | |
|---|---|
| ***E06B 5/20*** | (2006.01) |
| ***E06B 3/74*** | (2006.01) |
| ***E06B 3/72*** | (2006.01) |
| ***E06B 3/82*** | (2006.01) |
| *E06B 3/70* | (2006.01) |

(52) U.S. Cl.

CPC ..... *E06B 5/20* (2013.01); *E06B 3/72* (2013.01); *E06B 3/74* (2013.01); *E06B 3/822* (2013.01); *E06B 3/825* (2013.01); *E06B 2003/7023* (2013.01); *E06B 2003/7032* (2013.01); *E06B 2003/7049* (2013.01); *E06B 2003/7051* (2013.01); *E06B 2003/7061* (2013.01); *E06B 2003/7074* (2013.01); *E06B 2003/7082* (2013.01)

(58) Field of Classification Search

CPC ..... E06B 5/20; E06B 3/74; E06B 3/72; E06B 2003/7061; E06B 2003/7049; E06B 3/822; E06B 3/825; E06B 2003/7023; E06B 2003/7082; E06B 2003/7074; E06B 2003/7051; E06B 2003/7032

USPC ..... 181/284, 285, 286; 52/455, 456

See application file for complete search history.

(56) References Cited

U.S. PATENT DOCUMENTS

| | | | | | |
|---|---|---|---|---|---|
| 1,799,423 | A * | 4/1931 | Hubbert | E06B 3/5892 | 52/455 |
| 2,160,151 | A * | 5/1939 | Johnson | E06B 3/825 | 428/114 |
| 2,827,670 | A * | 3/1958 | Schwindt | E06B 3/7017 | 105/378 |
| 3,348,351 | A * | 10/1967 | Citarel | C08G 75/14 | 52/204.593 |

(Continued)

*Primary Examiner* — Brent W Herring

(74) *Attorney, Agent, or Firm* — DeLio, Peterson & Curcio, LLC; Peter W. Peterson

(57) ABSTRACT

A door having acoustical sound isolation properties includes a rail or stile having surfaces with a first, second and third planar portions stepped inward from and parallel to each other. Blocking layers are disposed parallel to and below one of the door surfaces, with each blocking layer having an edge with an extending flange contacting and extending along the second planar portion of the third surface of the stile or rail. The flanges of the blocking layers restrict movement of the layers toward each other. Soft acoustical material is disposed in the door interior. Flexible transition layers extend along the stile or rail third planar portions and extend over the blocking layers and the soft acoustical material to provide support against denting forces to the door.

20 Claims, 6 Drawing Sheets

(56) References Cited

U.S. PATENT DOCUMENTS 3,364,645 A * 1/1968 Wenzelberger ..... E06B 3/72 52/784.15
3,426,482 A * 2/1969 Mock ..... E06B 3/72 49/401
3,462,899 A 8/1969 Sherman
3,700,385 A * 10/1972 Sherwood ..... A47B 96/201 160/135
3,834,101 A * 9/1974 Wilder ..... E06B 3/78 428/122
4,068,431 A * 1/1978 Pitt ..... E06B 3/78 52/455
4,282,687 A * 8/1981 Teleskivi ..... E06B 5/16 428/688
4,374,693 A * 2/1983 Pitt ..... E06B 3/5892 156/267
4,429,498 A * 2/1984 Pitt ..... E06B 3/5892 52/204.705
4,752,517 A * 6/1988 Beitel ..... E06B 3/78 156/70
4,765,105 A * 8/1988 Tissington ..... E04C 2/382 264/46.5
4,998,598 A 3/1991 Mardian et al.
5,020,292 A * 6/1991 Strom ..... E06B 5/16 428/151
5,218,807 A * 6/1993 Fulford ..... B32B 3/18 49/501
5,361,552 A 11/1994 Fulford
5,448,869 A * 9/1995 Unruh ..... E06B 3/303 49/366
5,557,899 A * 9/1996 Dube ..... E06B 3/221 49/DIG. 2
5,839,252 A * 11/1998 Berghorn ..... E06B 3/822 52/475.1
6,112,496 A 9/2000 Hugus et al.
6,260,255 B1 * 7/2001 Richardson ..... A47F 3/0434 29/458
6,637,093 B2 * 10/2003 Richardson ..... A47F 3/0434 29/458
6,665,997 B2 * 12/2003 Chen ..... E06B 3/825 52/784.15
6,691,483 B2 * 2/2004 Lethers ..... E06B 7/32 49/169
6,962,031 B2 * 11/2005 Clarke ..... E05D 5/023 52/309.9
8,573,357 B1 11/2013 Hibbs
2003/0140587 A1 * 7/2003 Smith ..... E06B 3/725 52/455
2004/0226245 A1 * 11/2004 Clark ..... B32B 5/22 52/455
2005/0072085 A1 * 4/2005 Goudreau ..... E06B 3/10 52/455
2005/0076593 A1 * 4/2005 Bartlett ..... E06B 3/88 52/455
2010/0269450 A1 * 10/2010 Thielmann ..... E06B 3/72 52/784.15
2010/0281805 A1 * 11/2010 Garrett ..... E06B 3/822 52/309.4
2013/0228271 A1 * 9/2013 Garrett ..... E06B 3/822 156/242
2015/0360445 A1 * 12/2015 Cai ..... B32B 17/062 428/172

* cited by examiner

HIGH PERFORMANCE ACOUSTICAL WOOD DOOR

RELATED APPLICATIONS

This application claims priority from U.S. provisional patent application No. 62/198,939 filed on Jul. 30, 2015.

BACKGROUND OF THE INVENTION

1. Field of the Invention

The present invention is directed to a door having acoustical sound isolation properties and impact-resistant qualities.

2. Description of Related Art

Doors with acoustic-isolating properties are common in concert halls, movie theaters, broadcast studios, auditoriums, hospitals, factory floors and other rooms where noisy activity is frequent. For the most part, these doors contain a core made of material different from the material of the door's outer shell as a means of better isolating acoustical sounds. These doors function best when closed and sealed properly, maximizing sound isolation. Many of these doors also comprise of a framework within the door's outer shell which positions the sound isolating materials accordingly. To isolate and absorb noise effectively, it is important that a door be insulated, however, it is also important that the door be resistant to impact that may otherwise dent or change the shape of the door and result in a hindrance of its sound-isolating properties.

However, many designs focus only on the sound absorbing properties of the door itself, ignoring the overall structural quality of the door and its ability to withstand impact.

SUMMARY OF THE INVENTION

Bearing in mind the problems and deficiencies of the prior art, it is therefore an object of the present invention to provide a wood door and method of assembly that has improved acoustic sound isolation properties that additionally addresses impact resistance. Further, there is a need for an acoustic door and frame combination that is able to provide improved support to the door, and improved sound isolation.

It is another object of the present invention to provide a wood door and method of assembly that additionally improves impact resistance, and resistance to denting.

A further object of the invention is to provide a wood door and method of assembly that is able to provide improved support to the door, and subsequently improved sound isolation.

Still other objects and advantages of the invention will in part be obvious and will in part be apparent from the specification.

The above and other objects, which will be apparent to those skilled in the art, are achieved in the present invention which is directed to a door having acoustical sound isolation properties, the door having opposite outer surfaces and edges between the surfaces. The door includes a rail or stile extending adjacent an edge of the door which has a first surface facing toward the door edge, a second opposite surface facing inward toward an interior portion of the door, and a third surface between the first and second surfaces. The third surface has a first planar portion and a second planar portion stepped inward from and parallel to the first planar portion. The door also includes a blocking layer disposed in the interior portion of the door. The blocking layer is parallel to and below the door surfaces. The blocking layer has an edge and an extending flange contacting and extending along the second planar portion of the third surface of the stile or rail. The flange of the blocking layer restricts movement of the blocking layer, and the blocking layer provides acoustical sound isolation properties to the door.

The rail or stile may include a fourth surface between the first and second surfaces, opposite the third surface. The fourth surface may have a first planar portion and a second planar portion stepped inward from and parallel to the first planar portion. The door may further include a second blocking layer having an edge and an extending flange contacting and extending along the second planar portion of the fourth surface of the stile or rail. The blocking layers are spaced from each other, with the flanges of the blocking layers restricting movement of the blocking layers toward each other. The spaced blocking layers providing acoustical sound isolation properties to the door.

The door may further include a flexible sheet with acoustical sound isolation properties disposed between the first and second blocking layers.

Each of the third and fourth surfaces may further include a third planar portion between the first and second planar portions. The third planar portion is stepped inward from and parallel to the first planar portion and stepped outward from and parallel to the second planar portion. The door may include flexible transition layers contacting and extending along the third planar portions of the stile or rail, with the flexible transition layers extending over the blocking layers and below the door outer surfaces.

In a related aspect the present invention provides a door having acoustical sound isolation properties, the door having opposite outer surfaces and edges between the surfaces. The door includes a rail or stile extending along an edge of the door which has a first surface exposed along the door edge, a second opposite surface facing inward toward an interior portion of the door, and opposite third and fourth surfaces extending perpendicularly from the first surface toward the second surface. The third and fourth surfaces each have a first planar portion and a second planar portion stepped inward from and parallel to the first planar portion. The door also includes a first blocking layer parallel to and below one of the door surfaces. The first blocking layer has an edge contacting the rail or stile second surface and an extending flange contacting and extending along the second planar portion of the third surface of the stile or rail. The door further includes a second blocking layer parallel to and below the other of the door surfaces. The second blocking layer has an edge contacting the rail or stile second surface and an extending flange contacting and extending along the second planar portion of the fourth surface of the stile or rail. The door also includes a flexible sheet with acoustical sound isolation properties disposed between the first and second blocking layers. The flanges of the first and second blocking layers restrict movement of the layers toward each other, and first and second blocking layers are spaced apart from each other to provide acoustical sound isolation properties to the door.

In a further related aspect the invention is directed to a method of making a door having acoustical sound isolation properties. The method includes providing a rail or stile for an edge of the door, with the rail or stile having a first surface facing toward the door edge, a second opposite surface facing inward toward an interior portion of the door, and a third surface between the first and second surfaces. The third surface has a first planar portion and a second planar portion stepped inward from and parallel to the first planar portion. The method also includes providing a blocking layer having an edge and an extending flange, and applying the blocking layer parallel to and below one of the door surfaces in the interior portion of the door. The blocking layer flange contacts and extends along the second planar portion of the third surface of the stile or rail. The flange of the blocking layers restricts movement of the blocking layer, and the blocking layer provides acoustical sound isolation properties to the door.

The rail or stile may include a fourth surface between the first and second surfaces, opposite the third surface. The fourth surface has a first planar portion and a second planar portion stepped inward from and parallel to the first planar portion. The method may further include providing a second blocking layer having an edge and an extending flange and applying the second blocking layer parallel to and below one of the door surfaces in the interior portion of the door. The second blocking layer flange contacts and extends along the second planar portion of the fourth surface of the stile or rail. The blocking layers are spaced from each other, and the flanges of the blocking layers restricting movement of the blocking layers toward each other. The spaced blocking layers provide acoustical sound isolation properties to the door.

Each of the third and fourth surfaces may further include a third planar portion between the first and second planar portions. The third planar portion is stepped inward from and parallel to the first planar portion and stepped outward from and parallel to the second planar portion. The method may include applying flexible transition layers contacting and extending along the third planar portions of the stile or rail, with the flexible transition layers extending over the blocking layers and below the door outer surfaces.

In another aspect the present invention is directed to a door having acoustical sound isolation properties, the door having opposite outer surfaces and edges between the surfaces. The door includes a rail or stile extending along an edge of the door and having a first surface facing toward the door edge, a second opposite surface facing inward toward an interior portion of the door, and a third surface between the first and second surfaces. The third surface has a first planar portion and a second planar portion stepped inward from and parallel to the first planar portion. The door also includes a flexible transition layer contacting and extending along the second planar portion of the third surface of the stile or rail below the door outer surfaces. The flexible transition layer extends away from the door edge beyond the second surface of the stile or rail and toward the interior portion of the door to form a cantilevered perimeter along the rail or stile. The door further includes a soft acoustical material under the flexible transition layer and adjacent the rail or stile to provide acoustical sound isolation properties to the door. The flexible transition layer provides support against denting forces to the door outer surfaces in areas between the rail or stile and the soft acoustical material.

The rail or stile may include a fourth surface between the first and second surfaces, opposite the third surface. The fourth surface has a first planar portion and a second planar portion stepped inward from and parallel to the first planar portion. The door may further include a second flexible transition layer contacting and extending along the second planar portion of the fourth surface of the stile or rail below the door outer surfaces, opposite the first flexible transition layer. The second flexible transition layer extends away from the door edges beyond the second surface of the stile or rail and toward the interior portion of the door to form a cantilevered perimeter along the rail or stile. The soft acoustical material is between the flexible transition layers and adjacent the rail or stile to provide acoustical sound isolation properties to the door. The flexible transition layers provide support against denting forces to the door outer surfaces in areas between the rail or stile and the soft acoustical material.

In a related aspect the invention provides a door having acoustical sound isolation properties, the door having opposite outer surfaces and edges between the surfaces. The door includes a rail or stile extending along an edge of the door and having a first surface exposed along the door edge, a second opposite surface facing inward toward an interior portion of the door. The distance between the first and second surfaces is the rail or stile width. Opposite third and fourth surfaces extend perpendicularly from the first surface toward the second surface. The third and fourth surfaces are below the door outer surfaces and each have a first planar portion and a second planar portion stepped inward from and parallel to the first planar portion. The door also includes flexible transition layers contacting and extending along the second planar portions of the third and fourth surfaces of the stile or rail below the door outer surfaces. The flexible transition layers extend away from the door edge beyond the second surface of the stile or rail by a defined distance to form a cantilevered perimeter along the rail or stile. The door further includes a soft acoustical material between the flexible transition layers and adjacent the rail or stile to provide acoustical sound isolation properties to the door. The flexible transition layers provide support against denting forces to the door outer surfaces in areas between the rail or stile and the soft acoustical material.

In a further related aspect the present invention is directed to a method of making a door having acoustical sound isolation properties. The method includes providing a rail or stile for an edge of the door, the rail or stile having a first surface facing toward the door edge, a second opposite surface facing inward toward an interior portion of the door, and a third surface between the first and second surfaces. The third surface has a first planar portion and a second planar portion stepped inward from and parallel to the first planar portion. The invention also includes providing a flexible transition layer and providing a soft acoustical material. The method further includes applying the flexible transition layer to contact and extend along the second planar portion of the third surface of the stile or rail. The flexible transition layer extends away from the door edge beyond the second surface of the stile or rail and toward the interior portion of the door to form a cantilevered perimeter along the rail or stile. The method also includes applying the soft acoustical material under the flexible transition layer and adjacent the rail or stile to provide acoustical sound isolation properties to the door. The flexible transition layer provides support against denting forces to door outer surfaces in areas between the rail or stile and the soft acoustical material.

The rail or stile may include a fourth surface between the first and second surfaces, opposite the third surface. The fourth surface has a first planar portion and a second planar portion stepped inward from and parallel to the first planar portion. The method may further include providing a second flexible transition layer and applying the second flexible transition layer to contact and extend along the second planar portion of the fourth surface of the stile or rail below the door outer surfaces, opposite the first flexible transition layer. The second flexible transition layer extends away from the door edges beyond the second surface of the stile or rail and toward the interior portion of the door to form a cantilevered perimeter along the rail or stile. The soft acoustical material is disposed between the flexible transition layers and adjacent the rail or stile to provide acoustical sound isolation properties to the door. The flexible transition layers provide support against denting forces to the door outer surfaces in areas between the rail or stile and the soft acoustical material.

The above-described doors may further include opposite outer surfaces over the rail or stile, the blocking layers, the flexible transition layers, and/or the soft acoustical material.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description of an embodiment which follows taken in conjunction with the accompanying drawings in which:

DESCRIPTION OF THE EMBODIMENT(S)

Figure 1:
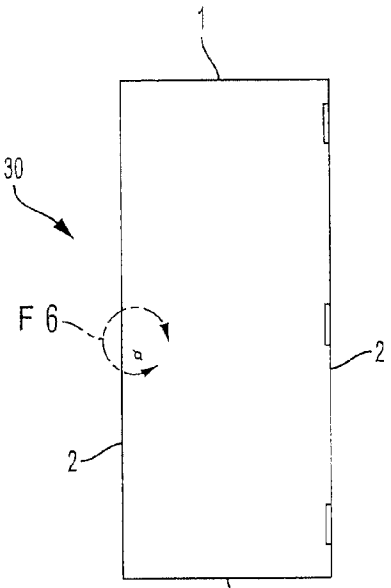
FIG. 1 is a side elevational view of one side of an example of the acoustical door of the present invention.
Figure 2:
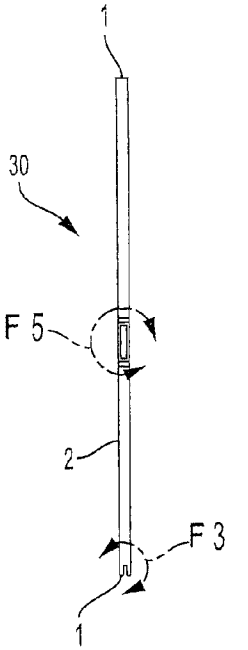
FIG. 2 is an end elevational view of the door of FIG. 1 along the left edge.
Figure 3:
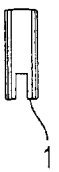
FIG. 3 is a close-up elevational view of the bottom portion of the door of FIG. 2 at area F3.
Figure 4:
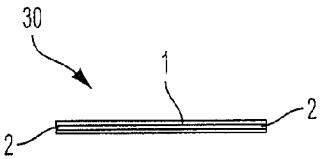
FIG. 4 is top plan view of the door of FIG. 1 along the top edge.
Figure 5:
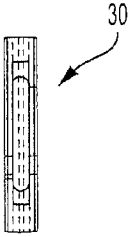
FIG. 5 is a close-up view of the lock portion of the door of FIG. 2 at area F5.
Figure 6:
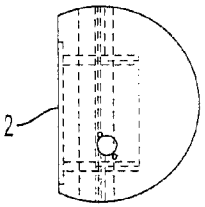
FIG. 6 is a close-up view of the lock portion of the door of FIG. 1 at area F6.

In describing the exemplary embodiment(s) of the present invention, reference will be made herein to FIGS. 1-17 of the drawings in which like numerals refer to like features of the invention.

The present invention is directed to the assembly of a sound isolating door with impact resistant qualities. The sound isolating materials within the door may vary based upon the level of sound absorption desired by the end user. It may be utilized in primarily commercial applications (e.g., offices, hospitals, government buildings, schools, sound studios, etc.) to provide high levels of interior sound attenuation through room opening. Typically this product can be installed into an acoustically enhanced commercial steel door frame that includes filled frame cavities and perimeter acoustical seals. An alternate use for the door of the present invention may be as a radiation shielding door (x-ray room) as it may be constructed with an appropriate amount (thickness) of lead for such application.

An embodiment of the acoustical door of the present invention is shown in FIGS. 1-16. The basic structural framework supporting door 30 includes vertical stiles 2 extending essentially the height of the door along opposite hinge and lock side edges, and top and bottom horizontal rails 1 extending normally to the stiles essentially along the entire width of the door on upper and lower edges, respectively. The rails and stiles provide support for the overlaid door skin components, as well as the inner components which contribute to the door properties, especially the sound isolating materials that provide acoustical sound absorption.

The outer skin components may comprise one or more essentially planar sheets or layers starting, from the door exterior outer surface layer, veneer/skin sheet 20 which may be rotary natural birch (RNB), for example; an adhesive layer 19 to bond skin 20 to the underlying layer, for example, polyvinyl acetate (PVA); a lead sheet 18 of desired thickness, for example, about 1/16" (1.5 mm) thickness; a skin backer sheet 17, for example, a high density fiberboard (HDF); and another adhesive layer to bond skin backer 17 to the undelaying core, for example, PVA. The door skin may comprise fewer or more layers to achieve the desired properties of the door. A horizontal closer block 5 is disposed below top rail 1 on one side of the door, and may be for example laminated strand lumber (LSL) or other engineered wood. A parallel closer block 4 is provided on the other side of the door below top rail 1 (FIG. 10), and the structure of the closer blocks in connection with the rails and stiles will be discussed in more detail below. A closer block acoustical sheet 6 may be disposed between closer blocks 4 and 5. Below closer blocks 4 and 5 there is disposed a horizontal blocking rail 3, which may be a LSL or other engineered wood.

Figure 11:
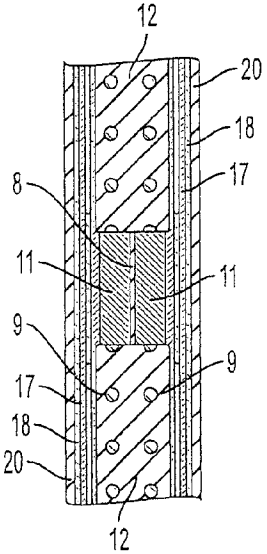
FIG. 11 is a close-up cross sectional view of the door of FIG. 9 in area F11.

Between the opposite outer skin layers and within top and bottom rails 1 and edge stiles 2 there may be provided core elements of material resistant to sound transmission, for acoustical properties. The layers and elements side of inner core segments may include one or more planar layers of an inner core 12 centered in the door below blocking rail 3, which may be soft acoustical cotton with fire resistance of desired thickness, for example, about 1.0 in. (25 mm) thickness, which layers may be provided as a plurality of separate segments arranged vertically such as the three (3) shown in FIG. 7. There may be included parallel horizontal lengths of inner core blocking 11 between inner core 12 segments, which blocking lengths are adhered by a visco elastic adhesive such as a caulk 8 (FIG. 11). Overlying inner core 12 and blocking 11 there may be provided a further acoustic layer, for example, a mass loaded vinyl core 10, which is adhered by assembly adhesive 21 such as polyurethane reactive (PUR) hot melt glue to overlying flexible perimeter rail transition layer or strip 14 and flexible perimeter stile transition layer or strip 13 extending along the horizontal and vertical periphery of core 10, respectively. One or more parallel core blocking spacers 15 of, for example, HDF, may extend horizontally between the vertical stile transition layers 13. The outer skin layer(s) may extend over peripheral transition layers 13 and 14, such as adhesive 16, skin backer sheet 17, adhesive 19, lead sheet 18, adhesive 19, and veneer/skin 20. The structure and function of the flexible perimeter transition layers in connection with the rails and stiles will be discussed in more detail below. These same core and outer skin layers and elements as discussed above and as shown in FIG. 7 may be replicated in the same sequence on the opposite side of the rail and stile framework and inner core segments to form the opposite sides of door 30.

Figure 10:
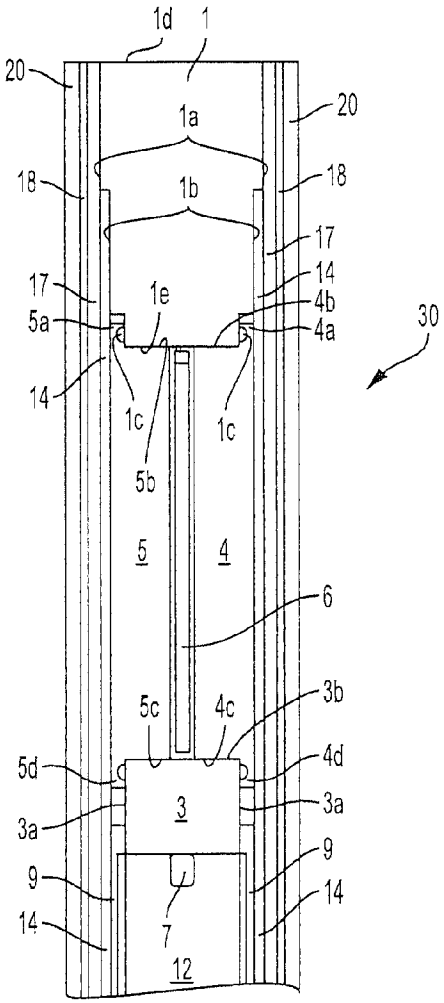
FIG. 10 is a close-up cross sectional view of the door of FIG. 9 in area F10.
Figure 9:
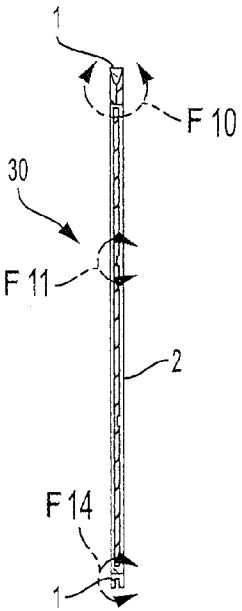
FIG. 9 is a cross-sectional view of the door of FIG. 8 along lines F9-F9.
Figure 8:
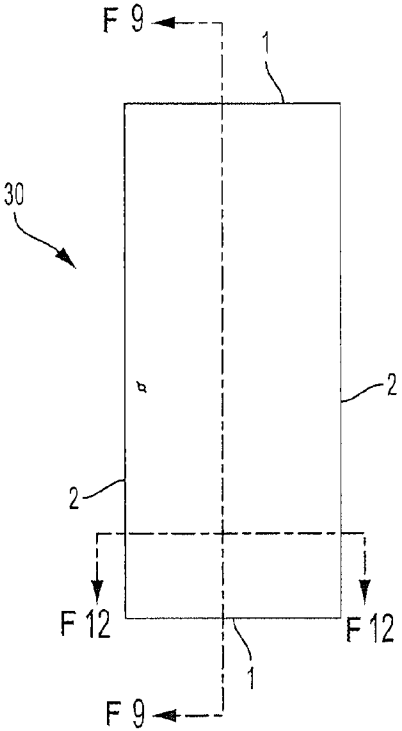
FIG. 8 is another side elevational view of one side of the acoustical door of the present invention.
Figure 12:
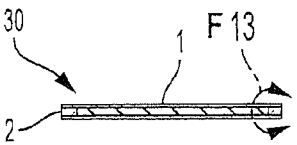
FIG. 12 is a cross-sectional view of the door of FIG. 8 along lines F12-F12.
Figure 13:
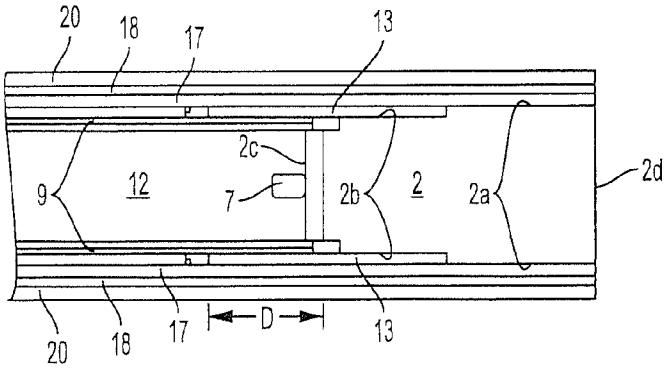
FIG. 13 is a close-up cross sectional view of the door of FIG. 12 in area F13.
Figure 15:
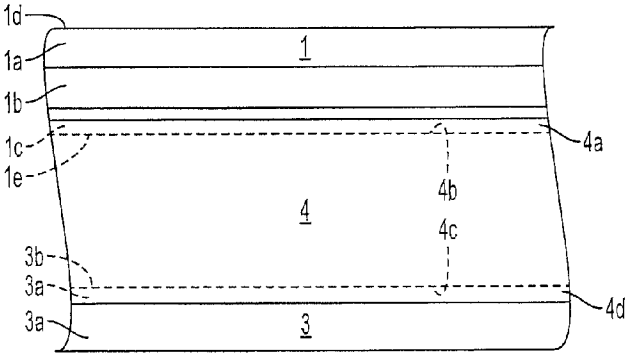
FIG. 15 is a front view of the top rail and block layer of the acoustical door of the present invention.
Figure 16:
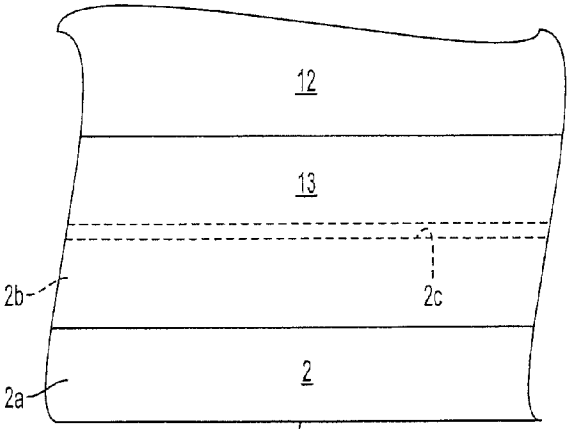
FIG. 16 is a front view of the flexible perimeter transition strip along a stile of the acoustical door of the present invention.

Profiled rails and stiles are shown in more detail in FIGS. 10 and 13. In FIG. 10, top rail 1 has an upper horizontal planar surface 1*d* forming the exposed upper edge of door 30. Rail opposite primary vertical planar surfaces 1*a* extend downward perpendicularly from surface 1*d* to receive and contact the three surface layers extending over the opposite outer sides of door 30, which surface layers may include one or more of a lower layer of a high density fiberboard (HDF) skin backer sheet 17, a middle layer of a lead sheet 18, and an outer exposed layer of a suitable veneer or skin 20, e.g., rotary natural birch (RNB). Suitable adhesives may be used to bond the layers together and to the rails primary surfaces 1*a*, e.g., PVA. Primary surface 1*a* may extend downward from upper edge 1*d* only a portion of the vertical distance of the rail. Opposite and parallel to rail upper edge 1*d* is planar horizontal lower surface 1*e*, which faces the interior of the door. Extending upward perpendicularly from horizontal surface 1*e* a portion of the vertical distance on both sides of top rail 1 are planar vertical surfaces 1*c*, which are parallel and stepped inward toward the center of the door with respect to primary surfaces 1*a*.

Disposed in vertical orientation below top rail 1 are a pair of elongated closer blocks or layers 4 and 5, extending horizontally across substantially the entire width of the door, parallel to each other. Closer blocks 4 and 5 may be made, for example, of LSL or other engineered wood, and provide additional support at the top of the door.

To support the closer blocks, blocks 4 and 5 have flanges 4*a* and 5*a*, respectively, extending vertically upward along the respective outer surfaces, and which contact and extend along vertical surfaces 1*c*. The upper surfaces 4*b*, 5*b* of the closer blocks contact lower rail surface 1*e*. Similarly, flanges 4*d* and 5*d* extend downward from the outer surfaces of closer blocks 4 and 5, respectively, and extend along and contact opposite sides 3*a* of blocking rail 3, which also may be made of LSL or other engineered wood. Any suitable adhesive may be used to secure the closer blocks to the rails 1 and 3. The flanges restrict movement of closer blocks 4 and 5 toward each other and suspend the closer blocks in proper spaced position to ensure separation and reduced sound transmission through the door. Optionally, a flexible sheet or layer 6 of mass loaded vinyl (MLV) may be disposed between closer blocks 4 and 5 for additional reduction in sound transmission as a result of its acoustical sound isolation properties.

Below and adjacent surfaces 1*a* and 1*c* on each side of top rail 1 are additional parallel vertical planar surfaces 1*b* stepped inward a distance from surface 1*a* toward the center of the rail, and stepped outward a distance from surface 1*c* away from the center of the rail. Surfaces 1*b* may extend a portion of the vertical distance of the rail between surfaces 1*a* and 1*c*. Surfaces 1*b* contact the inner surfaces of flexible perimeter rail transition strips 14, for example HDF, which is disposed between skin backer sheet 17 and closer block 4 on one side of the door, and between skin backer sheet 17 and closer block 5 on the other side of the door. The width of the transition strip is selected so that it extends from the top rail 1 to a limited distance beyond blocking rail 3 and over a portion of core 12.

Figure 7:
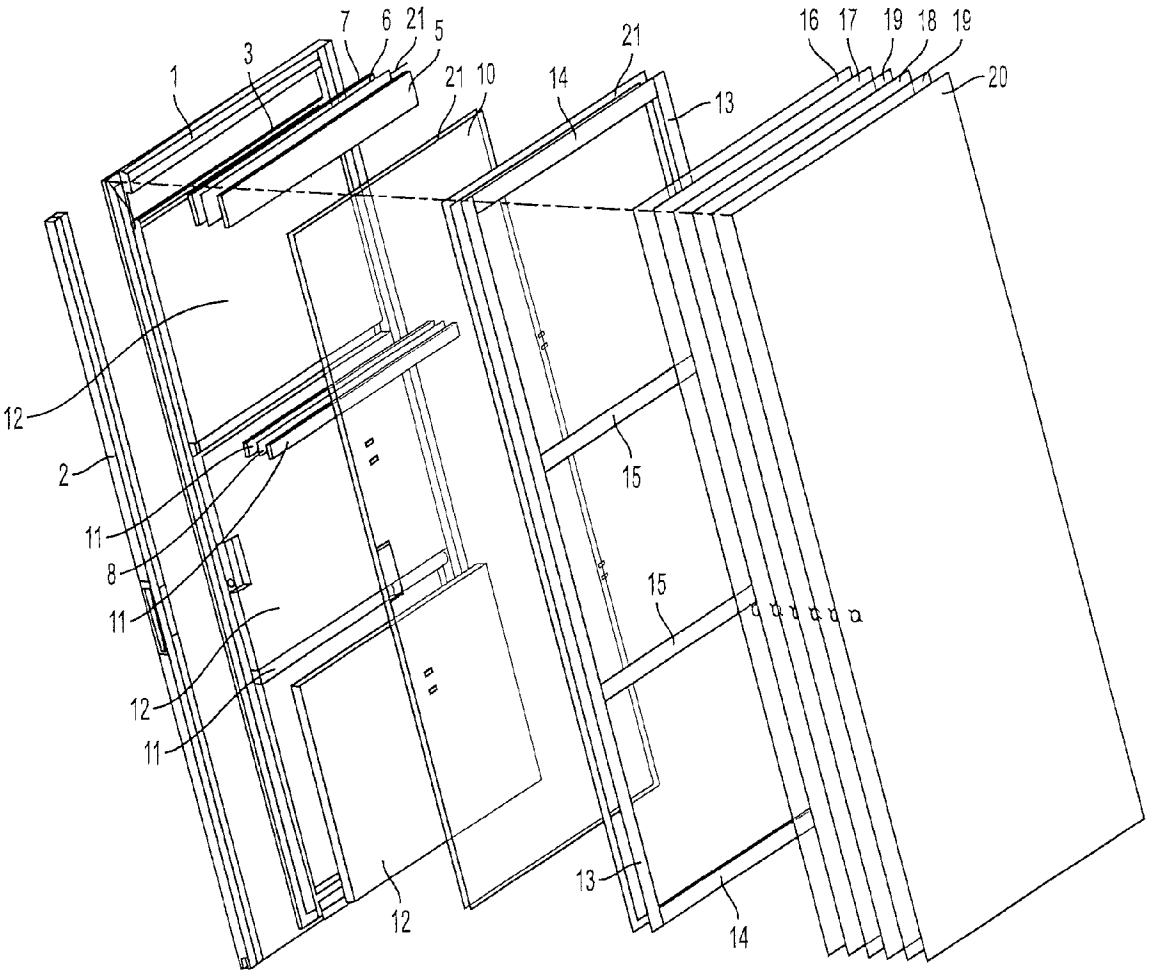
FIG. 7 is an exploded perspective view of a portion of the door of FIG. 1.
Figure 14:
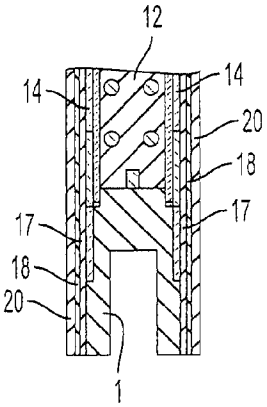
FIG. 14 is a close-up cross sectional view of the door of FIG. 9 in area F14.

Bottom rail 1 (FIG. 3) is constructed in a manner similar to top rail 1 (FIG. 10) and may have a notch cut into the center-bottom edge, this notch being cut through the entire length of the lower edge of door 30. FIG. 14 provides a more detailed view of, with the inner core segments 12 being adjacent to the top planar portion of bottom rail 1. The vertical outward-facing surfaces of bottom rail 1 may be constructed in a manner similar to the top rail, and are stepped inward a distance, with the planar surfaces of the stepped inward portion contacting and supporting the edge of flexible perimeter rail transition strips 14. Flexible perimeter rail transition strips 14 extend horizontally and parallel to the skin backer sheet 17, the core-facing surfaces of flexible perimeter rail transition strips 14 being adjacent to the inner core 12, and the outward-facing surfaces of flexible rail transition strips 14 being adjacent to skin backer sheet 17. The outward-facing layer of skin backer sheet 17 is adjacent to lead sheet 18, the outward-facing layer of which is subsequently adjacent to veneer/skin sheet 20. An adhesive 19 (as shown in FIG. 7) holds contact between skin backer sheet 17, and lead sheet 18, and between lead sheet 18 and veneer/skin sheet 20, the adhesive 19 which may compose of polyvinyl acetate.

The embodiment of the profiled stile in FIG. 13 shows stile 2 having an exposed planar surface 2*d* forming the vertical side edge of door 30 and an opposite parallel inner edge 2*c* adjacent the edge of acoustical core 12. Surfaces 2*a* extend perpendicularly on either side from surface 2*d* and receive and contact the three surface layers 17, 18, 20. In a manner similar to rail 1, planar vertical surfaces 2*b* are parallel and stepped inward toward the center of the door with respect to primary surfaces 2*a*. These surfaces 2*b* support and contact flexible perimeter stile transition strips 13, functionally identical to rail transition strips 14, which have widths selected to extend a limited distance D beyond surface 2*b* and over the edge of acoustical core 12.

Rails 1 and stiles 2 are relatively rigid, and acoustical core 12 is relatively soft. Transition strips 13 and 14 are flexible and have a rigidity or hardness between that of the rails/stiles on one hand and the soft core on the other, and form a cantilevered perimeter along the rail or stile that partially covers the core along the core's edge. The width or distance that the transition strips extend beyond the rail or stile may be determined depending on the flexibility of the door surface layers, and the flexibility and thickness of the transition strip material. For a typical door, the distance the transition strips 13, 14 extend over the soft core 12 typically may be up to about 1 inch (2.5 cm). The outer surfaces of the transition strips 14 and 13 are coplanar with the outer surfaces of the rails 1*a* and stiles 2*a*, respectively, so that the planar outer skin layer(s) may be applied directly over and contacting the rail and stile surfaces and the adjacent transition strips 14 and 13. The flexible transition layer provides support against denting forces to the door outer surfaces in areas between the rail or stile and the soft acoustical material, for example, when force is applied away from the rails or stiles.

Although FIG. 10 shows a rail 1, a stile may be constructed in the manner of rail 1 in FIG. 1. Likewise, although FIG. 13 shows a stile 2, a rail may be constructed in the manner of stile 2 as shown. The rail and style outer edges 1*d*, 2*d*, respectively, and other exposed edges may have integrated hardwood or may be covered with an adhesive bonded face veneer or laminate material.

The present invention may be assembled using multiple layers of various materials as described herein with specific steps detailed below and in the method 100 shown in FIG. 17. Material properties within each layer (e.g., density, tensile strength, sound absorption, and fire resistance) may be selected depending on the desired sound attenuation through the door and fire resistance. Material connection points and clearance may be selected to insure decoupling between layers to add sound resistance.

Figure 17:
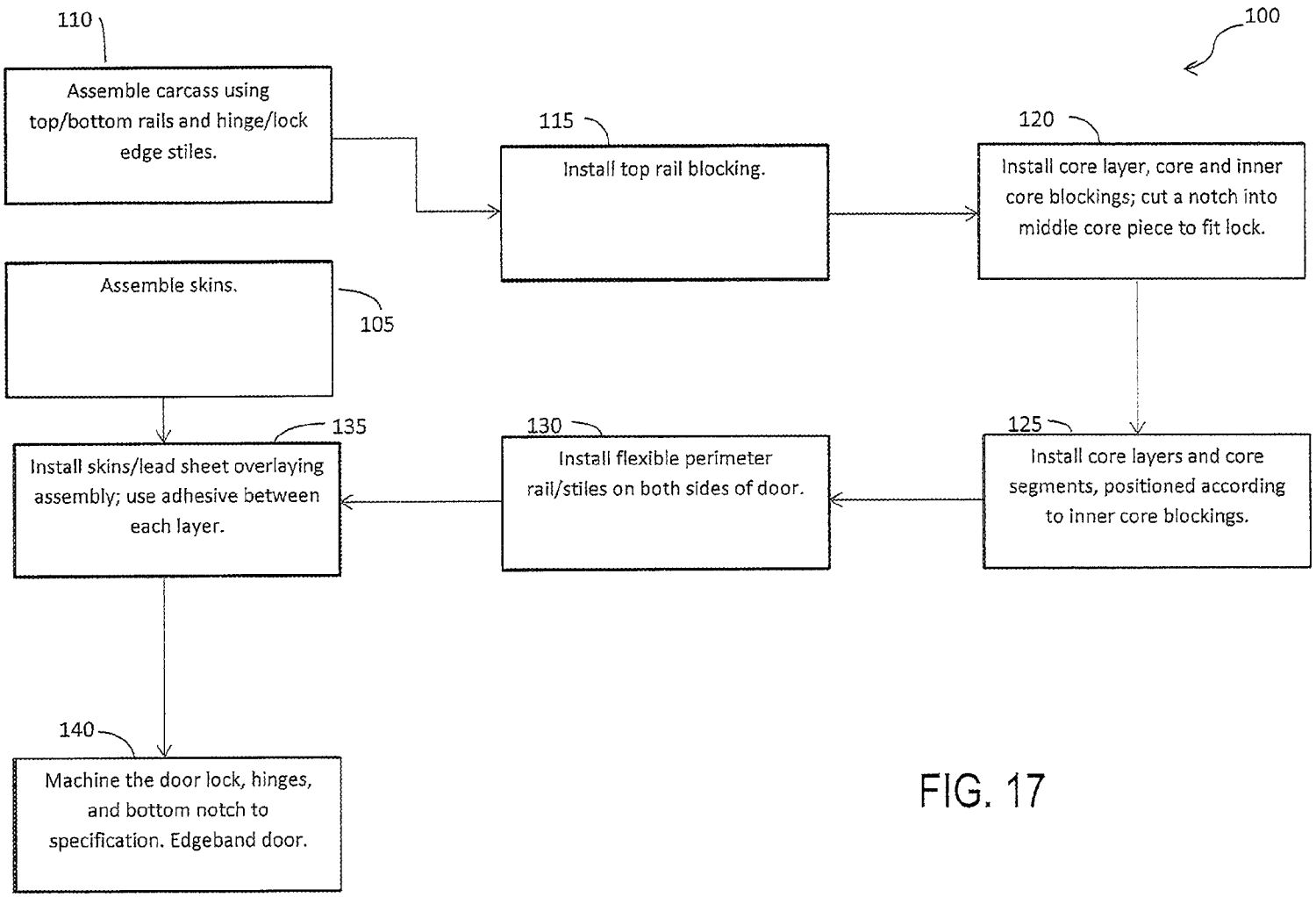
FIG. 17 is a flow chart of an assembly sequence showing an example of the method of manufacturing the acoustical door of the present invention.

Initially, referencing the assembly flow diagram of FIG. 17, the skins and carcass materials of the present invention may be selected and assembled, 105, 110, respectively. The carcass may be composed of a top and bottom rail 1, with the top, inward-facing edge of a hinge edge stile 2 contacting the outward-facing planar edge of the top rail 1 and running perpendicular to the top rail 1, the outward-facing planar edge of the bottom rail 1 contacting the bottom, inward-facing edge of the hinge edge stile 2, the bottom rail 1 running parallel to the top rail 1. A lock edge stile 2 may contact the opposite outward-facing planar edge of the top rail 1, running perpendicular to the top rail 1 and parallel to the hinge edge stile 2, the bottom, inwardly-facing edge of the lock edge stile 2 contacting the opposite outward facing planar edge of the bottom rail 1. The assembly typically results in a parallelogram-shaped carcass, composed of the top/bottom rails 1 and hinge/lock edge stiles 2. The top/bottom rails 1 and hinge/lock edge stiles 2 may compose of laminated strand lumber, for example.

Separately, the chosen skin layer(s) of veneer 20, sheet 18 and backer sheet 17 may be assembled for both opposite surfaces of the door, using one or more adhesives as described above.

The top rail blocking may be assembled 115 by installing the inside closer block 4 so that it is horizontally parallel and adjacent to the bottom edge of top rail 1 of the carcass. Top rail 1 has stepped in portions that create a groove in which the edge of closer blocks 4 and 5 fit. The top planar surface 4*b* of closer block 4 may contact bottom planar surface 1*e* of top rail 1, with the flange edge 4*a* of closer block 4 contacting the one edge 1*c* of top rail 1. Similarly, the top planar surface 5*b* of closer block 5 may contact bottom planar surface 1*e* of top rail 1, with the flange edge 5*a* of closer block 4 contacting the opposite edge 1*c* of top rail 1. Top rail blocking 3 is installed so that it is horizontally parallel and adjacent to the bottom edges of closer blocks 4 and 5, the bottom edges of closer blocks 4 and 5 being stepped in. The top edge of top rail blocking 3 may contact the horizontal edge 4*c* and vertical edge 4*d* of closer block 4 and the horizontal edge 5*c* and vertical edge 5*d* of closer block 4. Closer block acoustical sheet 6 may be installed between closer blocks 4 and 5, so that it is adjacent to and runs parallel with the top rail 1. An adhesive 21 may be used to bond the closer blocks 4 and 5 to the top rail 1 and the top rail blocking 3. Acoustical caulk 7 may be used on the face sides of closer block acoustical sheet 6 to bond to the closer blocks.

To install the core 120, initially one side 9 of the mass loaded core layer is installed over rail 3 and down to bottom rail 1, and between hinge and lock edge stiles 2. Over layer 9 is added the core 12 which may be composed of three blocks of material each cut to fit between the carcass rail and stile edges, the blocking rail 3, and the inner core blockings 11 (to be installed later). The first piece of core 12, which may be composed of soft acoustical cotton for example, may be placed within the carcass so that the top edge of the first piece of core 12 contacts the bottom edge of the top rail blocking 3, and the side edges of the first piece of core 12 contact both sides of the carcass at the opposite hinge/lock edge stiles 2. An inner core blocking 11, which may compose of soft cellulose fiber, may be installed below and adjacent to the bottom edge of the first piece of core 12. A second piece of inner core blocking 11 may be installed in the same manner and overlaying the first piece of inner core blocking 11, with a caulk 8 installed between and binding the two pieces of inner core blocking together. A second piece of core 12 may be placed beneath and adjacent to the bottom edge of the first inner core blocking 11. The edge of the second piece of core 12 adjacent to the lock edge stile 2 may be cut to specification in order to install the door lock (at a later step). Again, another piece of inner core blocking 11 may be installed adjacent to the bottom edge of the second piece of core 12, the inner core blocking 11 composed of two pieces of material overlaying each other, and bonded together by a caulk 8. The third piece of core 12 may be installed beneath the second inner core blocking 11, with the top edge of the third piece of core 12 being adjacent to the bottom edge of the second inner core blocking 11, the side edges of the third piece of core 12 being adjacent to the hinge/lock edge stiles of the carcass 2, and the bottom edge of the third piece of core 12 being adjacent to the top edge of bottom rail 1.

A sheet of the other side core layer 10 such as mass loaded vinyl may be installed 125 over the core 12 and other internal components, opposite core layer 9. The shape of the core layer 10 overlays the shape of the carcass and inner-core assembly and is essentially the same as core layer 9 on the opposite side, and the perimeter of core layers 9 and 10 may measure about the same as the inside perimeter of the carcass. The top edge of the other side core layer 10 should be adjacent to rail 3 and bonded to such by an assembly adhesive 21, of which may compose of polyurethane reactive hot melt glue, for example. The side edges of the other side core 10 are adjacent to and parallel with the hinge/lock edge stiles 2 of the carcass. The bottom edge of the other side core 10 is adjacent to and parallel with the bottom rail 1. An assembly adhesive 21, which may compose of polyurethane reactive hot melt glue, for example, is installed around the edges of the outward-facing surface of the other side core 10.

Flexible perimeter rail transition strips 13 and 14, which may be composed of high density fiberboard, for example, are installed 130 adjacent to the outward-facing surfaces of both of the blocking layers 4 and 5 and core layers 9 and 10. The top flexible perimeter rail transition layers 13 and 14 overlay the edges of the top and bottom rails 1, and over the outward-facing surfaces along the peripheries of the lower horizontal edges of core layers 9 and 10, with assembly adhesive 21 creating a bonding contact therebetween. The top and bottom flexible perimeter rail transitions 14 run horizontally and lay parallel to the top and bottom rails 1 of the carcass, respectively. Flexible perimeter stile transition strips 13 are also installed, which may compose of high density fiberboard, for example. The flexible perimeter stile transition strips 13 run vertically adjacent to and overlay the hinge/lock edge stiles 2 and over the outward-facing surfaces along the peripheries of the side vertical edges of core layers 9 and 10. An assembly adhesive 21 bonds the core-facing surfaces of the flexible perimeter stile transition strips 13 to the outward-facing surfaces of the hinge/lock edge stiles 2.

Core blocking spacers 15 of, for example, HDF, may be installed extending horizontally between transition strips 13 on opposite edges of the door. The core blocking spacers 15 may be installed adjacent to and overlaying the first and second inner core blockings 11, with core layers 9 and 10 between, the spacers 15 running parallel with the top/bottom rails 1. An adhesive 21 may be used.

The chosen door skin layers as may be installed 135 using an adhesive 16 first being overlaid onto the outward-facing surfaces of the carcass assembly.

The assembled door 30 is then machined 140 to the end user's desired size specifications, and any desired hinge and lock openings may be machined into the door 30 per the end user's specification. Optionally, the bottom rail 1 edge of the door 30 may be notched by machine to the desired specifications The invention may include one or more of the following features:

For the skin(s), durable 3 layered face material may be provided on each side of door, comprising lead between 2 layers of wood (one of which being the veneer/skin), e.g., skin-lead-HDF with glue layers in-between. The face material design is considerably more dent resistant that other similar products on the market, it reduces joint telegraphing, includes a massive layer for sound attenuation, and provides balance construction to minimize warping. Screw pull force is also improved.

Profiled rails and stiles may be provided as means for material lapping and for the suspension of internal blocking. Suspended blocking improves door rigidity and screw hold in strategic locations while maintaining decoupling of rigid materials parallel to sound transmission. Profiled features also provide means for repeatable assembly while minimizing contact between layers that are joined with adhesive, and enhanced corner strength of rail-to-stile joints.

Single layer acoustical cotton core may also provide sound attenuation across broad frequency range, a soft layer for decoupling of massive outer layers, and fire resistant and low thermal conductivity.

A floating core of acoustical material may be surrounded by layers of MLV. The material may be free to move by way of flexible outer core layer of mass loaded vinyl, and the core subassembly is able to be preassembled, moved, and sanded before skin application.

Cantilevered perimeter transition along rails and stiles may be provided as a flexible member to ease transition from rigid to none-rigid, and reduce the occurrence of joint telegraphing through face.

An acoustical multi-layer intermediate inner core blocking may be provided for increased rigidity to prevent skin warping and denting during operation and shipping/handling. It also provides fire resistant structure to maintain position of acoustical cotton and prevent exposure of cool side skin layer during a fire/fire test.

Acoustical top rail suspended closer blocking layers may be separated by mass loaded vinyl.

Thus, the present invention provides one or more of the objects of the invention, to achieve an improved high performance acoustical wood door having acoustical sound isolation properties, and impact-resistant qualities.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A door having acoustical sound isolation properties, the door having opposite outer surfaces and edges between the surfaces, the door comprising:

a rail or stile extending adjacent an edge of the door and having a first surface facing toward the door edge, a second opposite surface facing inward toward an interior portion of the door, and a third surface between the first and second surfaces, the third surface having a first planar portion and a second planar portion stepped inward from and parallel to the first planar portion; and a wood blocking layer extending within the interior portion of the door adjacent to the rail or stile and having an outer surface parallel to and below the door surfaces, the blocking layer further having an edge and a flange extending from the edge coplanar with the outer surface, the edge contacting the second surface and the extending flange contacting and extending along the second planar portion of the third surface of the stile or rail, wherein the flange of the blocking layer restricts movement of the blocking layer, the blocking layer providing acoustical sound isolation properties to the door.

2. The door of claim 1 wherein the rail or stile includes a fourth surface between the first and second surfaces, opposite the third surface, the fourth surface having a first planar portion and a second planar portion stepped inward from and parallel to the first planar portion, and further including a second blocking layer having an edge and an extending flange contacting and extending along the second planar portion of the fourth surface of the stile or rail, the blocking layers being spaced from each other, the flanges of the blocking layers restricting movement of the blocking layers toward each other, the spaced blocking layers providing acoustical sound isolation properties to the door.

3. The door of claim 2 further including a flexible sheet with acoustical sound isolation properties disposed between the first and second blocking layers.

4. The door of claim 2 further including opposite outer surfaces over the rail or stile and the first and second blocking layers.

5. The door of claim 2 wherein each of the third and fourth surfaces further include a third planar portion between the first and second planar portions, the third planar portion being stepped inward from and parallel to the first planar portion and stepped outward from and parallel to second planar portion, and including flexible transition layers contacting and extending along the third planar portions of the stile or rail, the flexible transition layers extending over the blocking layers and below the door outer surfaces.

6. A door having acoustical sound isolation properties, the door having opposite outer surfaces and edges between the surfaces, the door comprising:

a rail or stile extending along an edge of the door and having a first surface exposed along the door edge, a second opposite surface facing inward toward an interior portion of the door, and opposite third and fourth surfaces extending perpendicularly from the first surface toward the second surface, the third and fourth surfaces each having a first planar portion and a second planar portion stepped inward from and parallel to the first planar portion;

a first wood blocking layer extending within the interior portion of the door adjacent to the rail or stile and having an outer surface parallel to and below one of the door surfaces, the first blocking layer further having an edge contacting the rail or stile second surface and a flange extending from the edge coplanar with the outer surface, the extending flange contacting and extending along the second planar portion of the third surface of the stile or rail;

a second wood blocking layer extending within the interior portion of the door adjacent to the rail or stile and having an outer surface parallel to and below the other of the door surfaces, the second blocking layer further having an edge contacting the rail or stile second surface and a flange extending from the edge coplanar with the outer surface, the extending flange contacting and extending along the second planar portion of the fourth surface of the stile or rail; and a flexible sheet with acoustical sound isolation properties disposed between the first and second blocking layers, wherein the flanges of the first and second blocking layers restrict movement of the layers toward each other, first and second blocking layers being spaced apart from each other to provide acoustical sound isolation properties to the door.

7. The door of claim 6 further including opposite outer surfaces over the rail or stile and the first and second blocking layers.

8. The door of claim 6 wherein each of the third and fourth surfaces further include a third planar portion between the first and second planar portions, the third planar portion being stepped inward from and parallel to the first planar portion and stepped outward from and parallel to second planar portion, and including flexible transition layers contacting and extending along the third planar portions of the stile or rail, the flexible transition layers extending over the blocking layers and below the door outer surfaces.

9. A method of making a door having acoustical sound isolation properties, the method comprising:

providing a rail or stile for an edge of the door, the rail or stile having a first surface facing toward the door edge, a second opposite surface facing inward toward an interior portion of the door, and a third surface between the first and second surfaces, the third surface having a first planar portion and a second planar portion stepped inward from and parallel to the first planar portion;

providing a wood blocking layer having an outer surface, an edge and a flange extending from the edge coplanar with the outer surface;

applying the blocking layer parallel to and below one of the door surfaces in the interior portion of the door, the blocking layer edge contacting the second surface and the extending flange contacting and extending along the second planar portion of the third surface of the stile or rail; and wherein the flange of the blocking layers restricts movement of the blocking layer, the blocking layer providing acoustical sound isolation properties to the door.

10. The method of claim 9 wherein the rail or stile includes a fourth surface between the first and second surfaces, opposite the third surface, the fourth surface having a first planar portion and a second planar portion stepped inward from and parallel to the first planar portion, and further including providing a second blocking layer having an edge and an extending flange and applying the second blocking layer parallel to and below one of the door surfaces in the interior portion of the door, the second blocking layer flange contacting and extending along the second planar portion of the fourth surface of the stile or rail, the blocking layers being spaced from each other, the flanges of the blocking layers restricting movement of the blocking layers toward each other, the spaced blocking layers providing acoustical sound isolation properties to the door.

11. The method of claim 10 further including applying opposite outer surfaces over the rail or stile and the first and second blocking layers.

12. The method of claim 10 wherein each of the third and fourth surfaces further include a third planar portion between the first and second planar portions, the third planar portion being stepped inward from and parallel to the first planar portion and stepped outward from and parallel to second planar portion, and including applying flexible transition layers contacting and extending along the third planar portions of the stile or rail, the flexible transition layers extending over the blocking layers and below the door outer surfaces.

13. A door having acoustical sound isolation properties, the door having opposite outer surfaces and edges between the surfaces, the door comprising:

a rail or stile extending along an edge of the door and having a first surface facing toward the door edge, a second opposite surface facing inward toward an interior portion of the door, and a third surface between the first and second surfaces, the third surface having a first planar portion and a second planar portion stepped inward from and parallel to the first planar portion;

a soft acoustical material in the interior portion of the door adjacent the rail or stile to provide acoustical sound isolation properties to the door; and a flexible transition layer contacting and extending along the second planar portion of the third surface of the stile or rail below the door outer surfaces, the flexible transition layer extending away from the door edge beyond the second surface of the stile or rail and toward the soft acoustical material in the interior portion of the door to form a cantilevered perimeter along the rail or stile, the flexible transition layer extending over only a portion of the soft acoustical material, wherein the flexible transition layer provides support against denting forces to the door outer surfaces in areas between the rail or stile and the soft acoustical material.

14. The door of claim 13 wherein the rail or stile includes a fourth surface between the first and second surfaces, opposite the third surface, the fourth surface having a first planar portion and a second planar portion stepped inward from and parallel to the first planar portion, and further including a second flexible transition layer contacting and extending along the second planar portion of the fourth surface of the stile or rail below the door outer surfaces, opposite the first flexible transition layer, the second flexible transition layer extending away from the door edges beyond the second surface of the stile or rail and toward the interior portion of the door to form a cantilevered perimeter along the rail or stile, the soft acoustical material being between the flexible transition layers and adjacent the rail or stile to provide acoustical sound isolation properties to the door, wherein the flexible transition layers provide support against denting forces to the door outer surfaces in areas between the rail or stile and the soft acoustical material.

15. The door of claim 14 further including opposite outer surfaces over the rail or stile, the flexible transition layers, and the soft acoustical material.

16. A door having acoustical sound isolation properties, the door having opposite outer surfaces and edges between the surfaces, the door comprising:

a rail or stile extending along an edge of the door and having a first surface exposed along the door edge, a second opposite surface facing inward toward an interior portion of the door, the distance between the first and second surfaces being the rail or stile width, and opposite third and fourth surfaces extending perpendicularly from the first surface toward the second surface, the third and fourth surfaces being below the door outer surfaces and each having a first planar portion and a second planar portion stepped inward from and parallel to the first planar portion;

a soft acoustical material in the interior portion of the door adjacent the rail or stile to provide acoustical sound isolation properties to the door; and flexible transition layers contacting and extending along the second planar portions of the third and fourth surfaces of the stile or rail below the door outer surfaces, the flexible transition layers extending away from the door edge beyond the second surface of the stile or rail toward the soft acoustical material in the interior portion of the door by a defined distance to form a cantilevered perimeter along the rail or stile, the flexible transition layers extending over only a portion of the soft acoustical material, wherein the flexible transition layers provide support against denting forces to the door outer surfaces in areas between the rail or stile and the soft acoustical material.

17. The door of claim 16 further including opposite outer surfaces over the rail or stile, the flexible transition layers, and the soft acoustical material.

18. A method of making a door having acoustical sound isolation properties, the method comprising:

providing a rail or stile for an edge of the door, the rail or stile having a first surface facing toward the door edge, a second opposite surface facing inward toward an interior portion of the door, and a third surface between the first and second surfaces, the third surface having a first planar portion and a second planar portion stepped inward from and parallel to the first planar portion;

providing a flexible transition layer;

providing a soft acoustical material;

applying the soft acoustical material in the interior portion of the door adjacent the rail or stile to provide acoustical sound isolation properties to the door; and applying the flexible transition layer to contact and extend along the second planar portion of the third surface of the stile or rail, the flexible transition layer extending away from the door edge beyond the second surface of the stile or rail and toward the soft acoustical material in the interior portion of the door to form a cantilevered perimeter along the rail or stile, the flexible transition layer extending over only a portion of the soft acoustical material, wherein the flexible transition layer provides support against denting forces to door outer surfaces in areas between the rail or stile and the soft acoustical material.

19. The method of claim 18 wherein the rail or stile includes a fourth surface between the first and second surfaces, opposite the third surface, the fourth surface having a first planar portion and a second planar portion stepped inward from and parallel to the first planar portion, and further including providing a second flexible transition layer and applying the second flexible transition layer to contact and extend along the second planar portion of the fourth surface of the stile or rail below the door outer surfaces, opposite the first flexible transition layer, the second flexible transition layer extending away from the door edges beyond the second surface of the stile or rail and toward the interior portion of the door to form a cantilevered perimeter along the rail or stile, the soft acoustical material being disposed between the flexible transition layers and adjacent the rail or stile to provide acoustical sound isolation properties to the door, wherein the flexible transition layers provide support against denting forces to the door outer surfaces in areas between the rail or stile and the soft acoustical material.

20. The method of claim 19 further including providing and applying opposite outer surfaces over the rail or stile, the flexible transition layers, and the soft acoustical material.

* * * * *